US008720503B2

(12) United States Patent
Roberts et al.

(10) Patent No.: US 8,720,503 B2
(45) Date of Patent: May 13, 2014

(54) APPARATUS AND METHOD FOR PRODUCING BARREL STAVES

(75) Inventors: Ian Roberts, Aberfoyle Park (AU); John Whiting, Millswood (AU); Breck Waterman, Hawthorn (AU); Alan Conigrave, North Adelaide (AU); Graham Peacock, Grange (AU)

(73) Assignee: Southern Cross Cooperage Pty Ltd., Netley (AU)

( * ) Notice: Subject to any disclaimer, the term of this patent is extended or adjusted under 35 U.S.C. 154(b) by 784 days.

(21) Appl. No.: 12/301,236

(22) PCT Filed: May 17, 2007 (Under 37 CFR 1.47)

(86) PCT No.: PCT/AU2007/000665
§ 371 (c)(1), (2), (4) Date: Oct. 15, 2010

(87) PCT Pub. No.: WO2007/131294
PCT Pub. Date: Nov. 22, 2007

(65) Prior Publication Data

US 2012/0186701 A1 Jul. 26, 2012

(30) Foreign Application Priority Data

May 17, 2006 (AU) ..... 2006202071

(51) Int. Cl.
*B27H 3/02* (2006.01)

(52) U.S. Cl.
USPC ..... 147/19; 147/28; 147/35.5; 144/2.1; 144/360; 144/377

(58) Field of Classification Search
USPC ..... 147/18–23, 25–35.5; 144/2.1, 134.1, 144/360, 377
See application file for complete search history.

(56) References Cited

U.S. PATENT DOCUMENTS 3,710,836 A * 1/1973 Busch ..... 147/28
5,343,911 A * 9/1994 Humphrey ..... 144/134.1

* cited by examiner

*Primary Examiner* — Mark Rosenbaum
(74) *Attorney, Agent, or Firm* — Bio Intellectual Property Services LLC (Bio IPS); O. (Sam) Zaghmout

(57) ABSTRACT

The present invention therefore provides an improved apparatus and integrated method for producing barrel staves. The apparatus measures the profile of unfinished stave workpieces and based on the width and shape of the stave, as well as other parameters such as the type of barrel that is required, the edges of the stave are trimmed accordingly. This ensures fewer rejected staves, less waste in that the width of the unfinished stave is continuously measured across its entire length with minimum depth of cut required, and most importantly, barrel staves having extremely accurate jointed edges ensuring superior finished barrels have an internal surface that is free from undesirable spacing between the staves, utilizing less labor than hitherto known apparatus.

17 Claims, 8 Drawing Sheets

APPARATUS AND METHOD FOR PRODUCING BARREL STAVES

BACKGROUND OF THE INVENTION

The present invention relates to coopering and involves method and apparatus used in the process of manufacturing wooden staves. In particular, the present invention relates to an apparatus for mitring the edged profiles of elongate wooden pieces or blanks based on their width and shape to form wine and/or spirit barrel staves.

It is to be understood that although the present invention relates specifically to wooden staves used in the construction of barrels, it could equally well be applied to the dimensioning of plastic or even metal staves using the same principles.

In the process of manufacturing staves for use in the construction of wooden barrels, tubs, planters, and other containers of similar shape, hardwood trees such as oak are first cut into billets or tree sections of random lengths and widths. Typically, the size and shape of the sections depend upon the size of the wooden barrels for which the staves are being manufactured. These irregular wooden pieces are typically quarter sawn, cut into wedged or substantially pie shaped cross sections which are then cut to form rough or unfinished barrel staves.

The opposing side edges of the partially formed staves must be further processed by mitring the edged profiles for the purpose of forming joints with like surfaces of other staves forming a barrel. There are various known methods of mitering the edges of an unfinished stave.

For example, one such method is to mitre the edges by passing the stave through a power driven cutter to mitre a first edge and then positioning the stave on a second power driven cutter to mitre the opposite longitudinal side. The mitering operation is accomplished by visually or mechanically aligning the stave with the plane of the respective mitering cutter, and many times results in forming a stave with its side surfaces converging toward one end. This is undesirable and the stave must be rejected. Furthermore, such apparatus requires multiple personnel to operate.

More recent mitering techniques have involved the use of semi-automated equipment whereby an unfinished stave is made to travel along a track and is exposed to a pair of motor driven cutters which are arranged on either side of the track. Some of these apparatus include means to adjust the spacing between the cutters in response to a measured dimension of the unfinished stave. However, there are a number of problems associated with such equipment.

Firstly, prior art equipment which adjusts the spaced apart distance between cutters based on a dimension of the unfinished stave, is only suitable for producing staves having straight longitudinal sides. This is because the saws do not move during the cutting process, they are simply locked in the position governed by the measured dimension. This is not suitable for barrels such as wine or spirit barrels which require accurate profiled longitudinal sides.

Secondly, barrel forming staves often arrive at such workstations having variable widths along the length of the staves. Therefore, where the cut is based on only the leading or trailing edge width for example, this may result in an inaccurate cut because the width at the leading or trailing edge may be greater than the width at other points along the stave length. In other words, if the distance between saws is based solely on the leading edge width, there will be points along the stave where there is no material to be cut and will result in an uneven edge.

Most importantly though where an arcuate cut is required, that is, where the edge angle and profile is a function of barrel diameter, the width of the unfinished stave needs to be determined along its entire length to ensure that a maximum amount of material is used and that a minimum amount of material is wasted. No equipment known to the applicant is capable of producing such staves.

It is therefore an object of the present invention to overcome the aforementioned problems or to provide the public with a useful alternative.

SUMMARY OF THE INVENTION

Therefore in one form of the invention there is proposed an apparatus for producing a barrel stave for use in barrels of predetermined diameter, said apparatus including: sensing means used to measure at least one dimensional parameter of a stave work piece including a width of said stave work piece; and cutting means adapted to cut the stave work piece as a function of at least one measured dimensional parameter, including being adapted to cut a longitudinal side edge of said stave work piece at an angle determined as a function of said barrel diameter and said measured stave work piece width, the resultant side edge being adapted for flush abutment at an inner surface of said barrel with the longitudinal side edge of an adjacent stave formed by said apparatus.

Preferably said apparatus further includes means to transport the stave work piece through said sensing means and cutting means.

In preference said apparatus includes twin sensing means and twin cutting means.

In preference the twin sensing means is in the form of at least one pair of pivotable arms, each arm being positioned oppositely and on either side of the transport means such that a free end of each arm is biased against the stave work piece.

Preferably said sensing means is associated with the at least one pair of pivotable arms, said sensing means adapted to measure the extent of rotation of the arms as the work piece is transported therebetween.

Preferably the sensing means are in the form of electromechanical potentiometers.

In preference said apparatus further includes a computing means used to process data from the sensing means to thereby obtain a profile of the stave work piece width as a function of said arm rotation.

Advantageously, said sensing means obtain multiple data readings continuously along the entire length of the stave work piece.

In preference the transport means is in the form of a stable track including teeth adapted to grip a surface of said stave work piece.

Preferably said cutting means are movable with respect to opposing sides of the stable track, said movement determined as a function of said barrel diameter and said measured stave work piece width.

In preference said cutting means comprises twin rotary cutters positioned adjacent opposed sides of said track in a substantially horizontal plane, said rotating cutters being moveable between said horizontal plane and a position whereby said planes become disposed in a converging relationship toward opposing sides of the stable track, to thereby form said angled longitudinal side edges.

Preferably said twin rotary cutters are further moveable along said horizontal plane in a direction toward and away from opposing sides of the stable track.

Preferably the apparatus further includes a centring means for centring the stave so that it is received centrally on said transport means.

In preference said centring means is in the form of two further pairs of pivotable arms positioned prior to the sensing means pivotable arms, whereby each of said centring pivotable arms is located on either side of the transport means such that a free end of each arm is biased against the stave work piece.

In preference said apparatus further includes a hollower attachment adapted to shave the upwardly facing side of the stave.

In preference the hollower attachment is in the form of a cutting spindle positioned above the transport means, said cutting spindle being pivotably moveable toward said transport means.

Preferably the apparatus further includes a backing apparatus adapted to shave the downwardly facing side of the stave prior to being received through the sensing means and cutting means.

In preference the stave workpiece is centred prior to the backing apparatus using at least one pair of centring arms positioned on opposed sides of a centring arm conveyor transporting said stave work piece to the backing apparatus, wherein a free end of said arms is biased against said work piece.

Preferably the apparatus further includes a means of cutting the ends of the stave to a predetermined length prior to the backing apparatus.

In a further form of the invention there is proposed a barrel stave produced using the above defined apparatus.

In a still further form of the invention there is proposed a barrel including a plurality of barrel staves produced using the above defined apparatus.

In a yet further form of the invention there is proposed a method of producing a barrel stave of predetermined diameter, said method including the steps of:

measuring a dimensional parameter of a stave work piece, including the width of said stave work piece;

processing data relating to the measured width of the stave work piece and the barrel diameter to thereby calculate an optimum cut angle along the longitudinal side edge of the stave, enabling flush abutment at an inner surface of said barrel with the longitudinal side edge of an adjacent stave formed by said method; and cutting the stave work piece in accordance with said calculated optimum cut.

Preferably said method includes the further steps of:

processing data relating to the measured width of the stave work piece to thereby calculate an optimum cut along the longitudinal edge of the stave which ensures maximum use of material; and cutting the stave work piece in accordance with said calculated optimum cut.

In preference the above defined steps are performed simultaneously.

In preference the method includes a preliminary step of cutting opposed ends of the elongate stave work piece to form a stave work piece of predetermined length.

Preferably said method includes a further step of shaving a face of the stave work piece to a predetermined convex curve, said shaved face forming part of the external surface of a barrel.

Preferably said method includes a further step of hollowing a face of the stave work piece to a predetermined concave shape, said hollowed face forming part of the internal surface of a barrel.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 2:
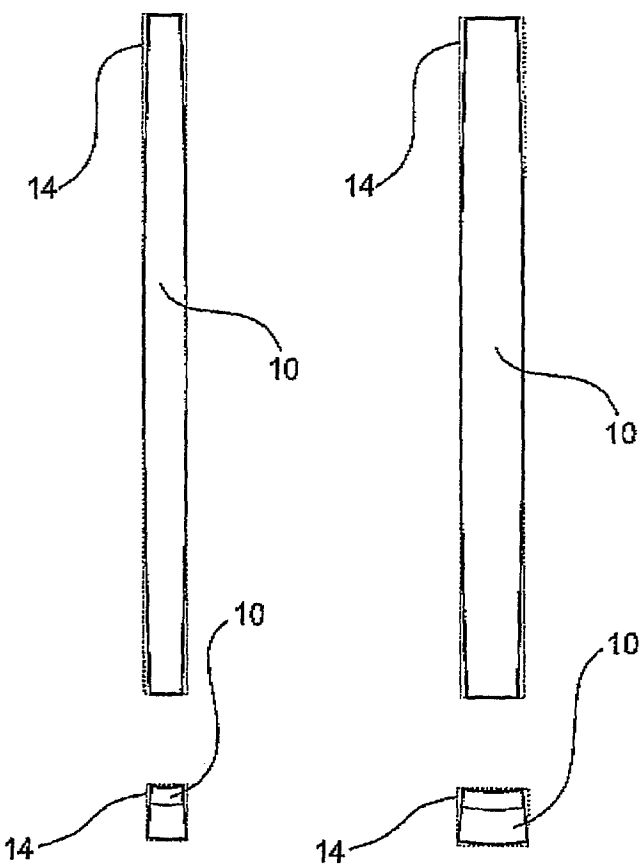
FIG. 2 illustrates both an enlarged side and enlarged cross-sectional view of two finished staves of the barrel of FIG. 1, including the unfinished stave work piece profile in broken lines.
Figure 1:
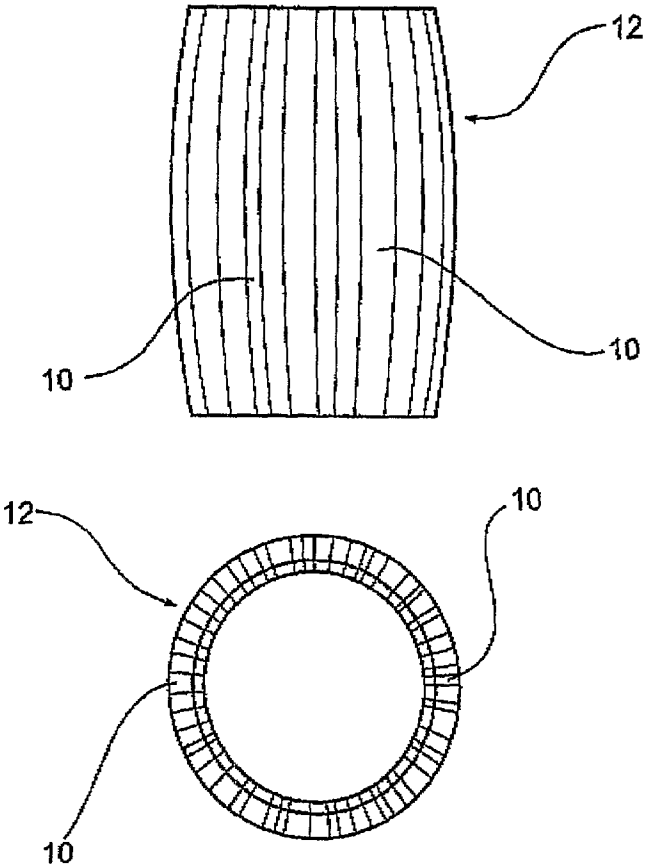
FIG. 1 illustrates both a side and cross-sectional view of a barrel made up of multiple wooden staves of differing transverse widths which have been measured and cut using the apparatus of the present invention.

The present invention relates primarily to a stave jointer apparatus used in the manufacture of barrel staves 10. FIG. 1 illustrates a barrel 12 constructed using a plurality of staves 10 which have been dimensioned using the apparatus of the present invention and subsequently joined along the longitudinal mitre edges. As mentioned in the preamble of the invention, unfinished stave work pieces typically arrive at stave jointing workstations in a plurality of different widths, typically ranging from 2 inches to 6 inches. The dimensions of these unfinished work pieces is shown in broken lines 14 in FIG. 2 whilst the finished stave, that is, the stave which has been cut using the apparatus of the present invention, is shown in full lines.

Figure 3:
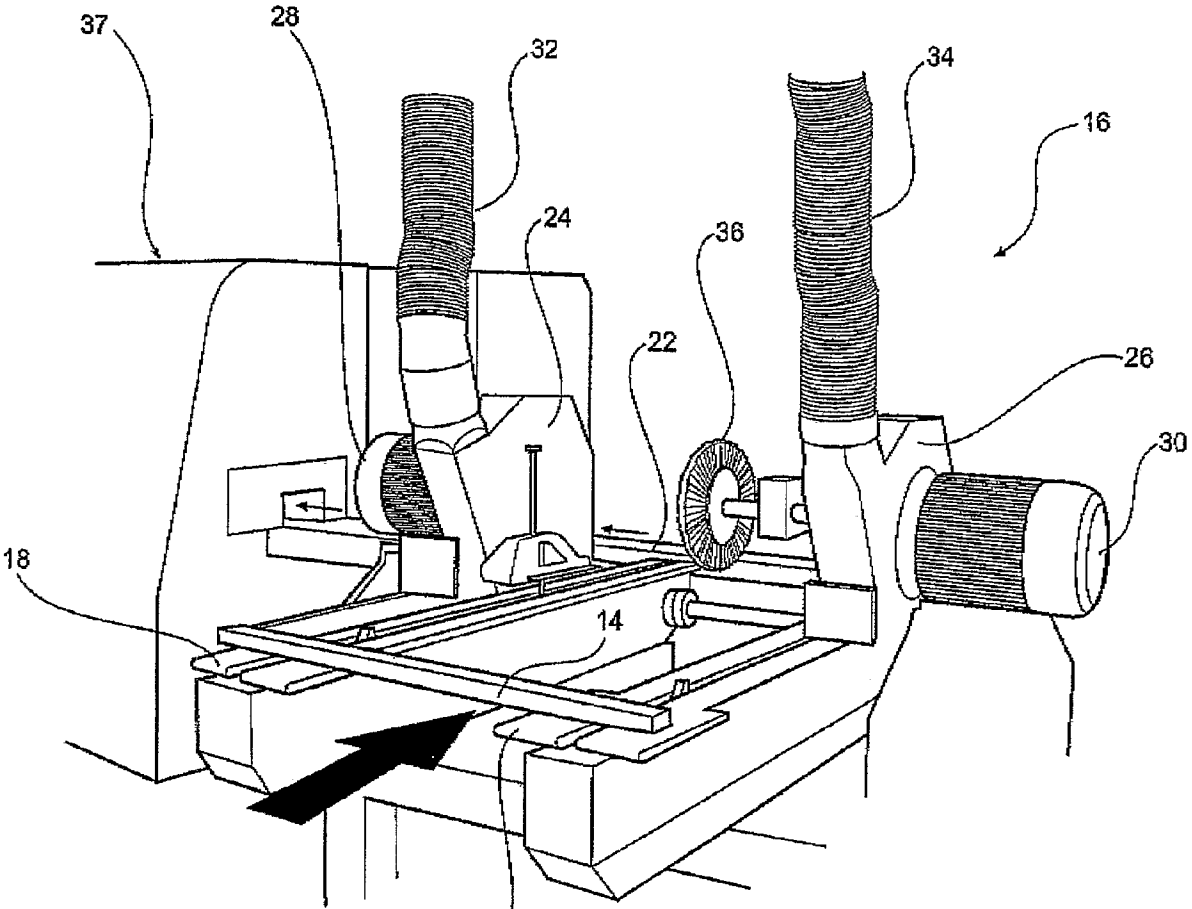
FIG. 3 illustrates a perspective view of a docking machine used to cut the length of the barrel staves.

The stave jointer apparatus described herein is responsible for forming the mitre joint and profile cuts along the longitudinal edges of the stave, and also concaving the inner surface and concaving the outer surface of the stave. However, the unfinished staves must also be cut to a measured length before the width is measured and cut. A docking machine 16 is responsible for this and is illustrated in FIG. 3. Unfinished stave workpieces 14 are adapted to be placed onto two conveyors 18 and 20 forming part of the docking machine 16. The conveyors 18 and 20 are in a spaced apart arrangement such that the ends of the work pieces are supported thereon, and transported in the direction of a backing in-feed conveyor 22. Before reaching the backing in-feed conveyor 22, the stave ends are simultaneously cut by saws 24 and 26 associated with conveyors 18 and 20 respectively. The saws 24 and 26 are driven by respective electric motors 28 and 30, and include respective dust extraction chutes 32 and 34. Brushes 36 are driven by a motor (not shown) and are located in a position such that their spinning motion causes the staves to be pushed onto the backer conveyor 22 once the ends are sawn off. Only one brush is shown in the drawing.

The backing in-feed conveyor 22 is responsible for delivering staves 14 from the docking machine 16 to the backing apparatus 37, which is responsible for concaving the face of the stave which will ultimately form part of the outer surface of the barrel. The backing apparatus is followed by the measuring 38 and jointing 40 apparatus respectively, which are later described. The operation of the in-feed conveyor 22 is interlocked with the operations of the measuring 38 and jointing 40 apparatus, and stops whenever there is an interruption in the jointing program. The mechanism which determines when there is an interruption in the jointing program is described further below. It is to be understood that the speed of the in-feed conveyor 22, as well as the speed of all of the conveyors described herein is adjustable.

Figure 4:
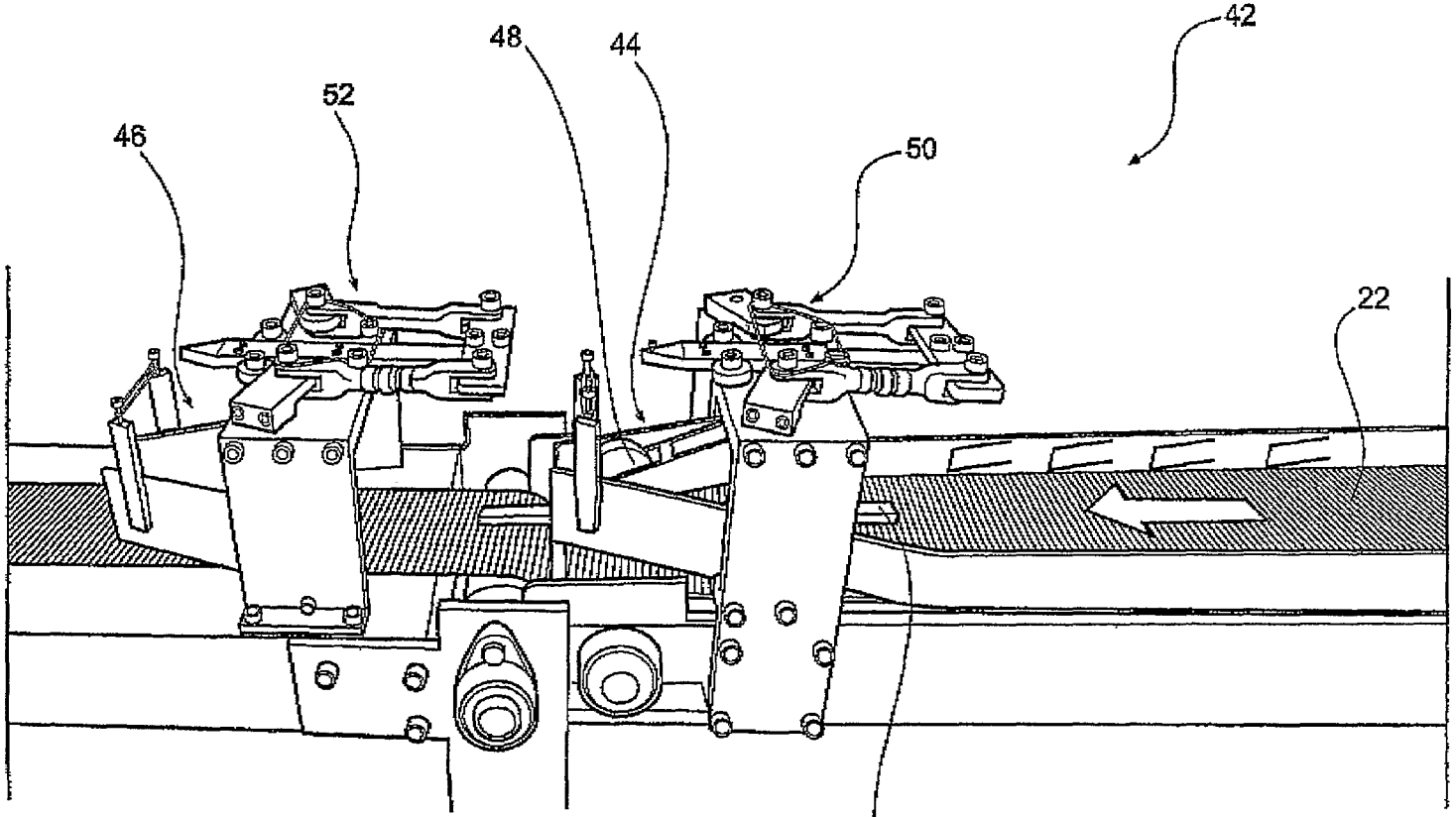
FIG. 4 illustrates a perspective view of a centring arm area used to centre the stave workpiece prior to entering the backing apparatus.

Before arriving at the backing apparatus 37, the stave workpiece 14 must first be centred on the conveyor 22. Accordingly, the in-feed conveyor includes a centring arm area 42 which is illustrated in FIG. 4. In FIG. 3, this area is hidden behind saw 24 and its associated motor 28.

The centring arm area 42 includes spaced apart centring arm pairs 44 and 46. Opposed arms of each centring arm pair 44 and 46 are biased toward one another in such a manner that when the workpiece 14 moves therethrough, they contact the longitudinal edge of the stave and thereby position it directly in the centre of the conveyor 22. There are two adjoining conveyors shown, however, these are both described as a single conveyor having the same reference number 22. This process is aided by a guide roller 48 positioned between the arms of the first arm pair 44. The biasing means 50 and 52 is the same for each arm pair and involves an arrangement of pivoting members and elastic bands which, in the interest of brevity, will not be described here in any great detail. When the leading edge of the stave 14 reaches the second centring arm pair 46 the trailing edge is still moving through the first pair 44. This ensures that the stave is centred along its entire length.

Figure 5:
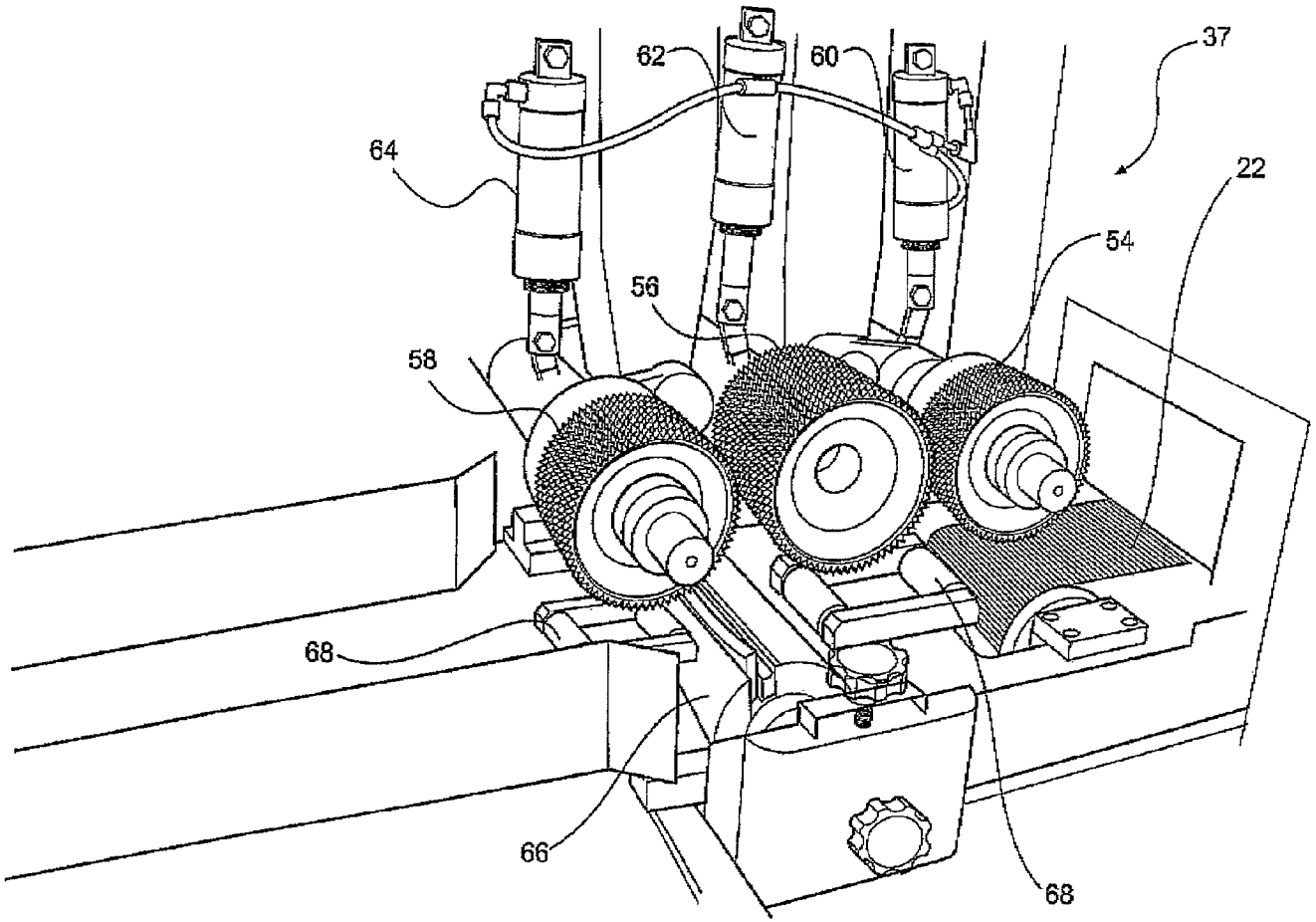
FIG. 5 illustrates a perspective view of a backing apparatus used to shave the underside surface of the stave workpiece to form a convex outer barrel surface.

The backing apparatus 37 is shown in detail in FIG. 5 where it can be seen that once a stave workpiece 14 has been centred, it then undergoes a downward force applied in sequence by three hydraulic rollers 54, 56 and 58 positioned thereabove. Upward and downward movement of the rollers 54, 56 and 58 is achieved through use of associated hydraulic pistons 60, 62 and 64 respectively. Each of the rollers includes serrated surfaces for slightly gripping the stave as it passes to avoid sideways movement of the stave during the cutting process. A rotary cutter 66 is located beneath the stave path for cutting and thereby shaping the outer (or downward facing) surface of the stave into a substantially concave shape. There are also base rollers 68 for assisting smooth movement of the stave from conveyor 22 to a further conveyor 70. Movement of the rotary cutter 66 is computer controlled so that it may achieve the required curve on the underside surface of the stave workpiece 14.

As mentioned, the stave is fed onto a further conveyor 70, which us used to transport the stave to the measuring 38 and jointing 40 apparatus. This conveyor 70 includes a sensor (not shown) used to sense when there is a back up of material, for example, where a stave may have become jammed in the measuring 38 and jointing 40 apparatus. The sensor sends a signal to a control computer (not shown) to halt the entire process so that someone can locate where the stave is jammed and remedy the problem.

Figure 6:
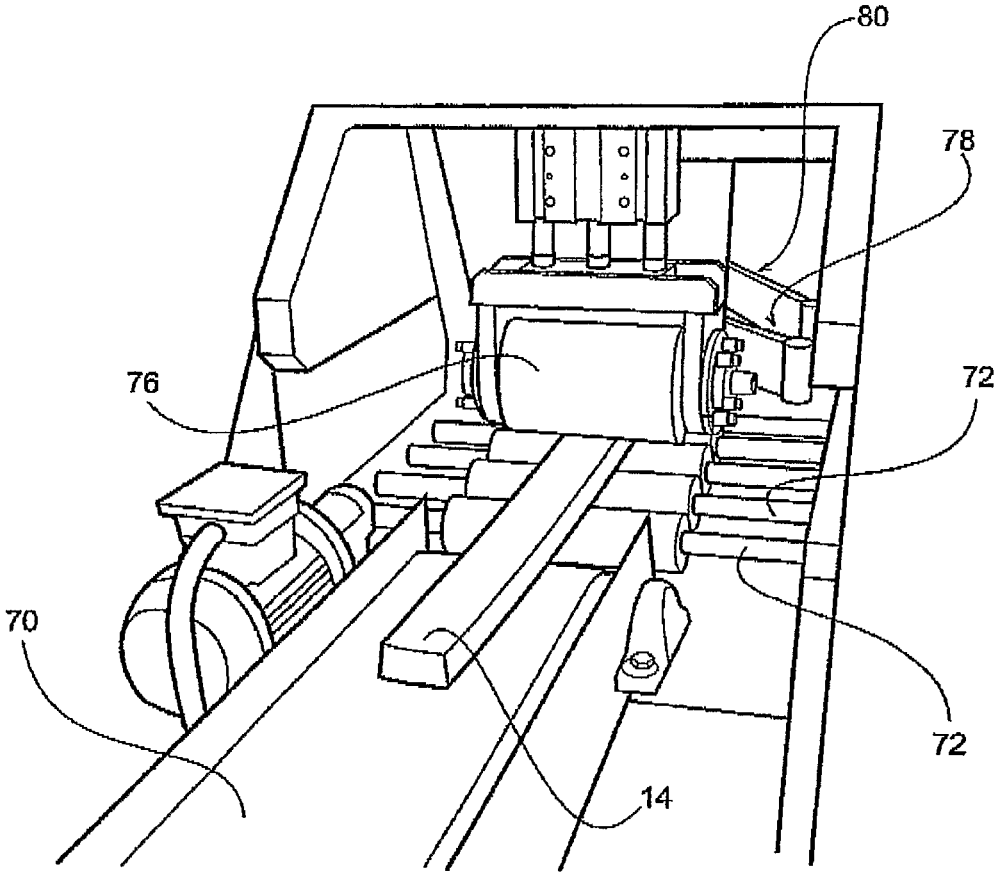
FIG. 6 illustrates a perspective view of a stave work piece about to enter the measuring and jointing apparatus of the present invention.
Figure 7A:
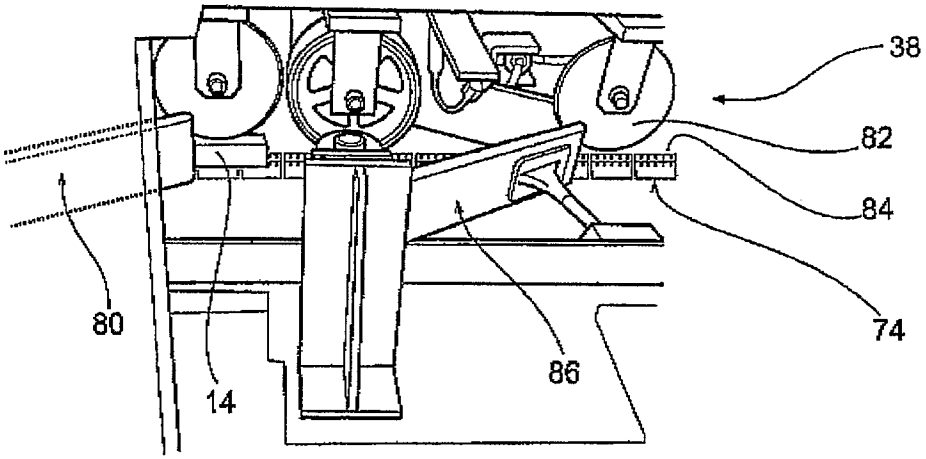
FIG. 7*a* illustrates a side perspective view of a stave work piece entering the measuring apparatus of the present invention.
Figure 7B:
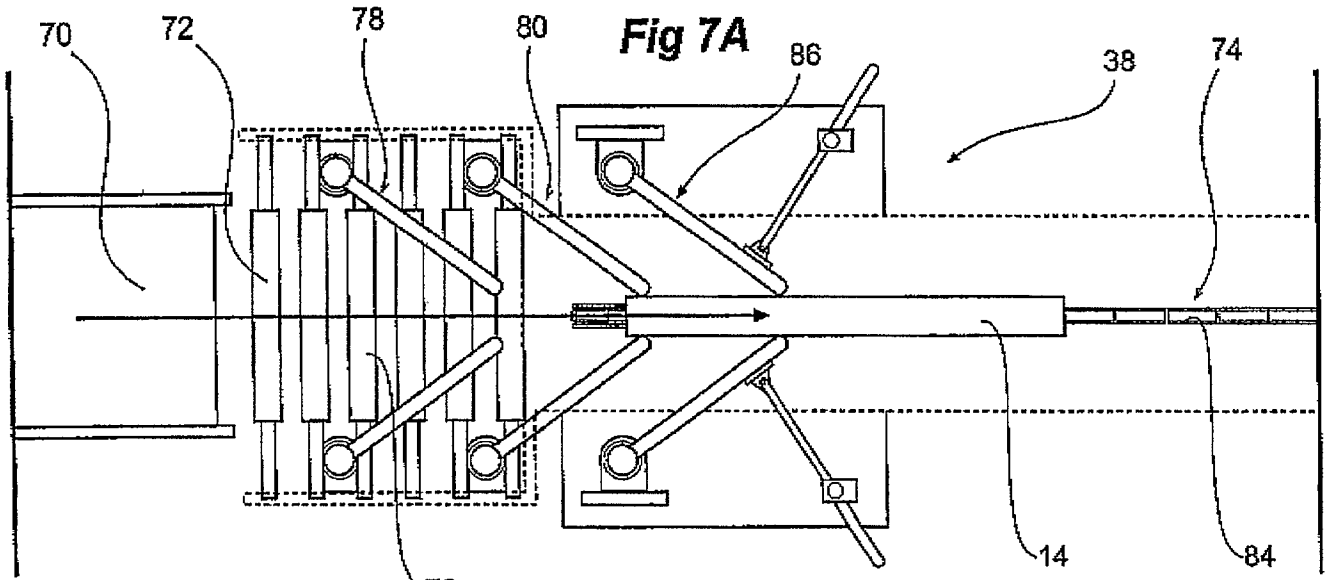
FIG. 7*b* illustrates a top view of the measuring apparatus of FIG. 7*a;*

The stave is now ready to be measured and jointed and the apparatus involved is shown clearly in Figures is process is shown clearly in FIGS. 6-8. The stave is transported by the conveyor 70 onto a series of rollers 72 which are positioned just before the start of a drag chain 74. The drag chain 74 is the primary moving system through the apparatus and is driven by a motor (not shown). An in-feed pinch roller 76, which is a sensor activated pneumatic roller, presses the stave 14 down against a drive wheel (not shown) for feeding the stave onto the drag chain 74. But before this process, the stave once again needs to be centred, and this is achieved using two pairs of centring arms 78 and 80 which are configured to bias against the longitudinal edge of the stave to thereby keep it centred. A sensor (not shown) associated with pinch roller 76 detects stave 14 and activates a plurality of pneumatically operated hold down rollers 82 positioned above the drag chain 74, that are used to push down on the stave 14 to maintain the grip of the drag chain teeth 84.

Measuring is achieved using a further pair of opposed arms 86, similar to the abovementioned measuring arms 78 and 80, which are spaced further along the drive chain 74. The measuring arm pair 86 continuously measures the width of the stave 14 as it passes through using electro-mechanical potentiometers (not shown). Rather than measuring a single width, for example at the leading edge or in the middle or at the trailing edge of the stave 14, the apparatus 38 allows for measurements to be taken along the entire longitudinal edges of the stave 14. This information is then sent to the abovementioned control computer for processing.

The control computer analyses the input from the measuring arm pair 86 and translates that information into a unique stave shape profile based on the type of barrel selected for production, and the shape, contour and width of each stave. All of the settings, such as the barrel type, trim settings and cutter diameters can be adjusted or modified, and predetermined barrel settings can be stored for future use. For example, hogs head barrels, barrique barrels and puncheon barrels will each have different predetermined end circumferences, belly circumferences, and stave lengths, and the control computer compensates for each of these requirements.

Figure 8B:
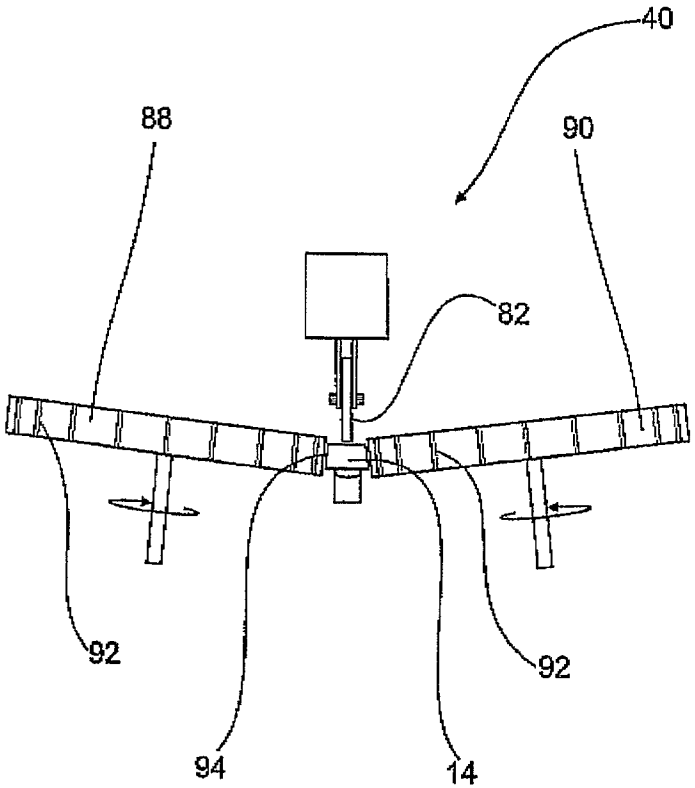
FIG. 8*b* illustrates a front view of a stave being cut by the jointing apparatus of FIG. 8*a;*
Figure 8A:
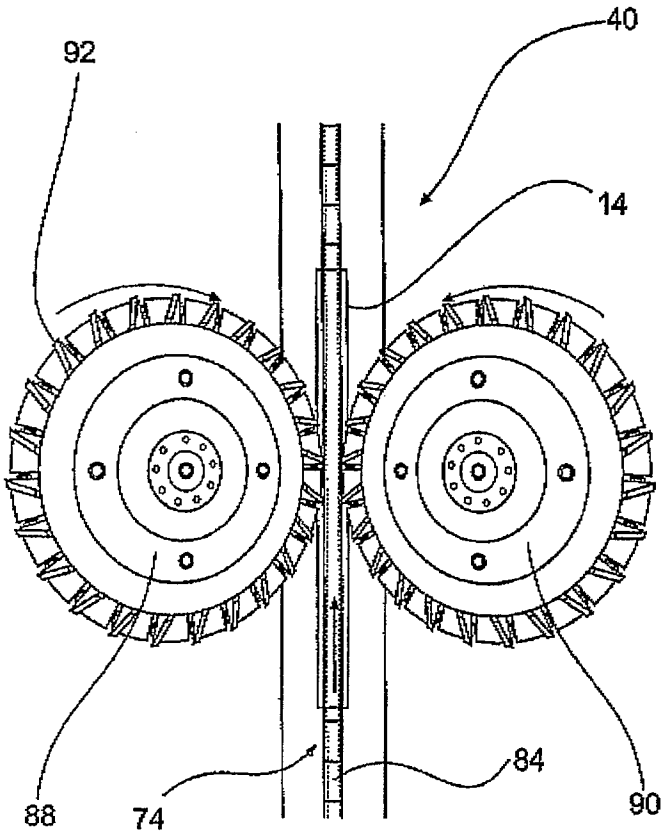
FIG. 8*a* illustrates a top view of a stave being cut by the jointing apparatus of the present invention.

The control computer then sends operating instructions to the jointing apparatus 40 shown in FIG. 8*a* and FIG. 8*b*. The jointing apparatus 40 comprises two servo controlled, circular rotating cutters 88 and 90 which form an accurate cut along the longitudinal edges of the work piece 14 as a function of its measured dimensions. The cutters 88 and 90 include a plurality of blades 92 positioned around the outside surface of the cutters. Movement of the cutters 88 and 90 is provided by computer controlled servo motors (not shown) and ball screw systems (not shown) which allow the cutters to be adjusted for depth of cut and tilt trim, according to the computer determined optimum profile. The primary movement of the cutters is inward tilt as shown clearly in FIG. 8*b*, this providing the diagonal side edge 94 of the staves, and horizontal movement towards and away from the stave 14, to thereby create a desired profile therealong. The computer essentially determines the optimum profile of the stave edges as it is transported through the measuring arms 86. In preference, the control computer also includes a means to display a graphical model of the stave 14.

Figure 9B:
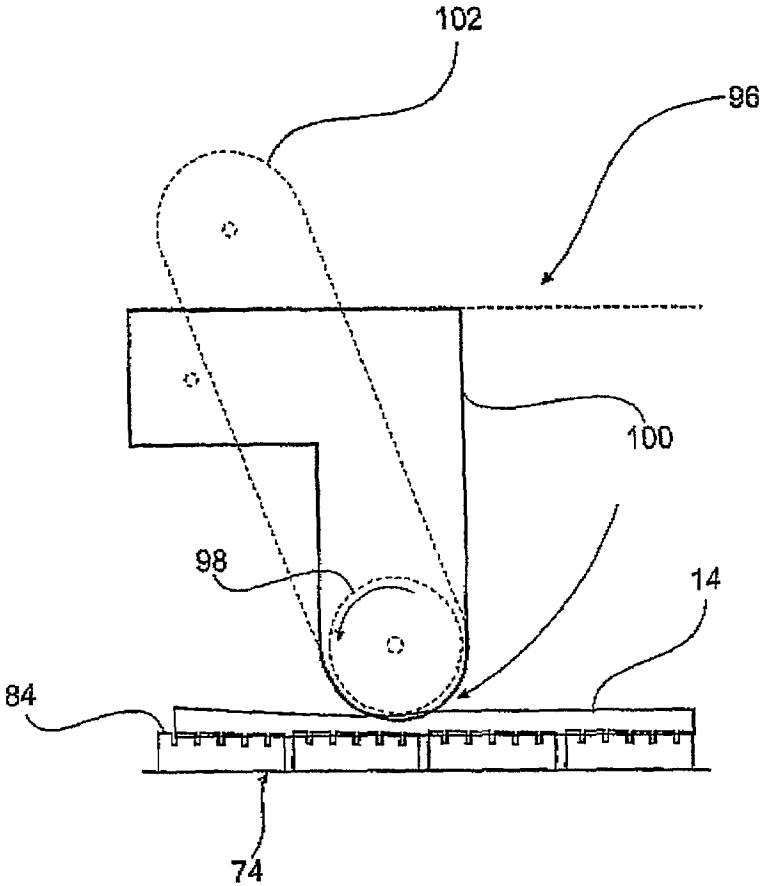
FIG. 9*b* illustrates a side view of a stave being hollowed by the pivotable hollower attachment of FIG. 9*a*.
Figure 9A:
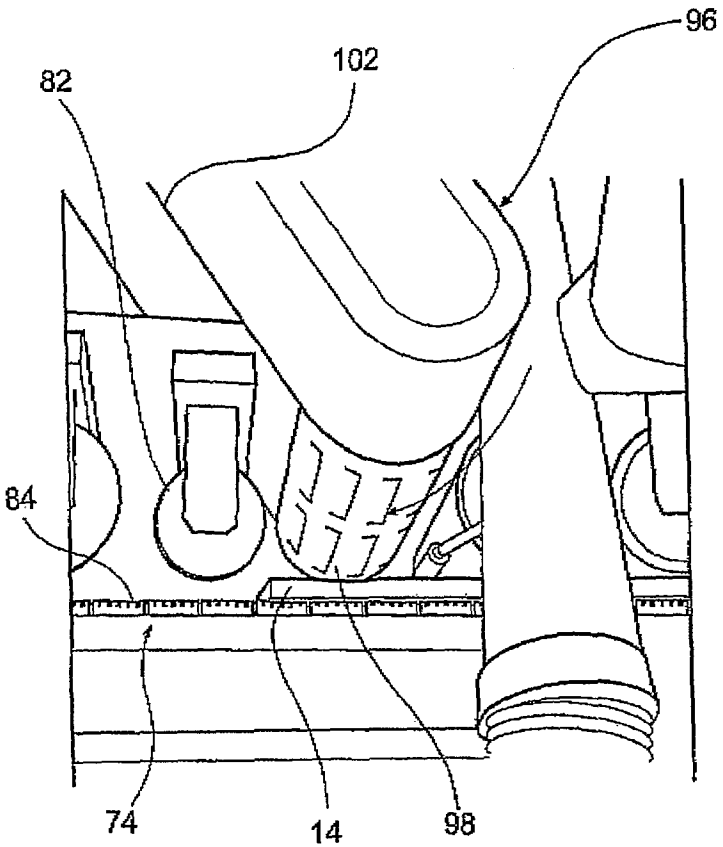
FIG. 9*a* illustrates a lower side perspective view of a pivotable hollower attachment used to hollow the upper surface of the stave work piece to form a concave inner barrel surface.

At this stage, the length of the stave has been cut, the stave has been backed, the profile of the stave mapped, and the stave edges cut accordingly. Finally, the inner surface of the stave (the surface facing upwardly) must be hollowed out, or convexed, to thereby form the internal surface of the barrel 12. A hollower attachment 96 is shown in FIGS. 9*a* and 9*b* and is positioned at the discharge end of the stave jointer apparatus. The attachment comprises a cutting spindle 98 including adjustment means (not shown) for depth of cut and withdrawal height. In particular, the cutting spindle 98 is housed within a pivotable housing 100 and is thus pivotably adjustable. A further housing 102 is shown which is used to house the drive chain (not shown) linking the spindle 98 to an associated motor (not shown). Movement of the housing 106 is also controllable via the control computer. There are further upper rollers 82 which maintain the stave in position on the drag chain during hollowing of the stave.

Following the hollowing process, the finished stave 10 enters a discharge conveyor (not shown) which delivers the jointed staves for raising a barrel 12.

It is to be understood that the stave jointer apparatus of the present invention includes other features which have not been described herein but which are also important in its operation. Some of these additional features include:

- cutter guard housings located on each side of the drag chain adjacent the cutters to guard against cutter tip failure, preferably mounted on a rolling track system to access the cutters for maintenance and routine cleaning;
- cutter motor lock outs located inside the cutter guard housing, used as additional protection during maintenance procedures and routine cleaning to ensure employee safety or accidental or inadvertent start up of the cutters;
- a main air pressure regulator to regulate system pressure, incorporating a low pressure sensor that will shut down the apparatus in the case of a drop in pressure;
- a hold down roller pressure regulator system used to control the air pressure delivered to each of the various hold down rollers mentioned above; and
- emergency stop switches and various other safety equipment.

The present invention therefore provides an improved apparatus and integrated method for producing barrel staves 10. The apparatus measures the profile of unfinished stave work pieces and based on the width and shape of the stave, as well as other parameters such as the type of barrel that is required, the edges of the stave are trimmed accordingly. This ensures fewer rejected staves, less waste in that the width of the unfinished stave is continuously measured across its entire length with minimum depth of cut required, and most importantly, barrel staves having extremely accurate jointed edges ensuring superior finished barrels have an internal surface that is free from undesirable spacing between the staves, utilising less labour than hitherto known apparatus.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. An apparatus for producing a barrel stave for use in a barrel of predetermined diameter, said apparatus including:

twin sensing means used to measure the width of a stave work piece along the entire length of said stave work piece; and twin cutting means adapted to cut the stave work piece as a function of the width of said stave work piece along the entire length of said stave work piece, including being adapted to cut a longitudinal side edge of said stave work piece at an angle and at a depth determined as a function of said barrel diameter and said measured stave work piece width along the entire length of said stave work piece, the resultant side edge being adapted for flush abutment at an inner surface of said barrel with the longitudinal side edge of an adjacent stave formed by said apparatus.

2. An apparatus as in claim 1 wherein said apparatus further includes means to transport the stave work piece through said twin sensing means and said twin cutting means.

3. An apparatus as in claim 2 wherein said apparatus further includes a hollower attachment adapted to shave the upwardly facing side of the stave.

4. An apparatus as in claim 3 wherein the hollower attachment is in the form of a cutting spindle positioned above the transport means, said cutting spindly being pivotably moveable toward said transport means.

5. An apparatus as in claim 2 wherein said twin sensing means is in the form of at least one pair of pivotable arms, each arm being positioned oppositely and on either side of the transport means such that a free end of each arm is biased against the stave work piece.

6. An apparatus as in claim 5 wherein said sensing means is associated with the at least one pair of pivotable arms, said sensing means adapted to measure the extent of rotation of the arms as the workpiece is transported therebetween.

7. An apparatus as in claim 5 wherein the sensing means is in the form of electromechanical potentiometers.

8. An apparatus as in claim 7 wherein said apparatus further includes a computing means used to process said data from the sensing means to thereby obtain a profile of the stave work piece width as a function of said rotation of the arms.

9. An apparatus as in claim 8 wherein the transport means is in the form of a stable track including teeth adapted to grip a surface of said stave work piece.

10. An apparatus as in claim 9 wherein said cutting means are movable with respect to the stable track, said movement determined as a function of said barrel diameter and said measured stave work piece width.

11. An apparatus as in claim 9 wherein said twin cutting means comprises twin rotary cutters positioned adjacent opposed sides of said track in a substantially horizontal plane, said rotating cutters being moveable between said horizontal plane and a position whereby said planes become disposed in a converging relationship toward opposing sides of the stable track, to thereby form said angled longitudinal side edges.

12. An apparatus as in claim 11 wherein said twin rotary cutters are further moveable along said horizontal plane in a direction toward and away from opposing sides of the stable track.

13. An apparatus as in claim 1 wherein said sensing means obtains multiple data readings continuously along the entire length of the stave work piece.

14. A method of producing a barrel stave of redetermined diameter, said method including the steps of:

measuring the width of a stave work piece along the entire length of said stave work piece;

processing data relating to the measured width of said stave work piece along the entire length of said stave work piece and the barrel diameter to thereby calculate an optimum cut angle and depth along the longitudinal side edge of the stave, enabling flush abutment at an inner surface of said barrel with the longitudinal side edge of an adjacent stave formed by said method; and cutting the stave work piece in accordance with said calculated optimum cut.

15. A method as in claim 14 including a preliminary step of cutting opposed ends of the elongate stave work piece to form a stave work piece of predetermined length.

16. A method as in claim 14 including a further step of shaving a face of the stave work piece to a predetermined convex curve, said shaved face forming part of the external surface of a barrel.

17. A method as in claim 14 including a further step of hollowing a face of the stave work piece to a predetermined concave shape, said hollowed face forming part of the internal surface of a barrel.

* * * * *